United States Patent [19]

Helling et al.

[11] Patent Number: 4,987,061

[45] Date of Patent: Jan. 22, 1991

[54] HEAT DEVELOPABLE COLOR PHOTOGRAPHIC RECORDING ELEMENT

[75] Inventors: Günter Helling, Odenthal; Manfred Peters, Leverkusen, both of Fed. Rep. of Germany

[73] Assignee: Reel/Frame Agfa-Gevaert Aktiengesellschaft, Leverkusen, Fed. Rep. of Germany

[21] Appl. No.: 426,521

[22] Filed: Oct. 24, 1989

Related U.S. Application Data

[63] Continuation of Ser. No. 940,433, Dec. 11, 1986, abandoned.

[30] Foreign Application Priority Data

Dec. 21, 1985 [DE] Fed. Rep. of Germany ..... 3545607

[51] Int. Cl.[5] ..... G03C 1/76

[52] U.S. Cl. ..... 430/531; 430/332; 430/336; 430/351; 430/357; 430/536; 430/537; 430/539

[58] Field of Search ..... 430/531, 621, 536, 537, 430/539, 332, 336, 351

[56] References Cited

U.S. PATENT DOCUMENTS

| | | | |
|---|---|---|---|
| 3,957,491 | 5/1976 | Miyazako et al. | 430/627 |
| 4,120,725 | 10/1978 | Nakazyo et al. | 430/627 |
| 4,594,315 | 6/1986 | Shibue et al. | 430/531 |

*Primary Examiner*—Jack P. Brammer

*Attorney, Agent, or Firm*—Connolly & Hutz

[57] ABSTRACT

Color images with improved Dmin/Dmax-relationship can be obtained from color photographic recording materials comprising color providing compounds in association to silver halide emulsion layers and comprising an additional binder in said silver halide emulsion layers or in adjacent non-lightsensitive layers a polymer having recurring structural units of a polymerized monomer which contains at least one urethane and/or urea group.

4 Claims, No Drawings

HEAT DEVELOPABLE COLOR PHOTOGRAPHIC RECORDING ELEMENT

This application is a continuation of application Ser. No. 940,433, filed Dec. 11, 1986.

This invention relates to a color photographic recording material comprising at least one photosensitive silver halide emulsion layer applied to a layer support and at least one non-diffusing color-providing compound associated with the silver halide emulsion layer, the silver halide emulsion layer or an adjacent binder layer containing a synthetic polymer as additional binder.

In the field of color photographic recording materials, experts are always confronted by the problem of producing dye images of the highest possible color density from existing color providing compounds. An advance in this direction would enable the quantity of color providing compound and/or the quantity of silver halide used to be reduced, which would be of advantage in regard to optical and mechanical properties (for example sharpness, flexibility) by virtue of the resulting reduction in the load on the layer, i.e. in the thickness of the layer which would be made possible in this way. Another advantage would be, for example, a reduction in the necessary processing time or processing under milder conditions.

This applies in particular, for example, to thermally developable color photographic (color-photothermographic) recording materials. It is known that colored images can be produced by heat treatment of suitable color photographic recording materials. In this case, particularly suitable color providing compounds are those which may be incorporated in non-diffusing form in the layer of a photographic recording material and which are capable of releasing a diffusible dye in consequence of development (dye-releasing compounds). The particular suitability of dye-releasing compounds of the type in question arises out of the fact that the dyes released imagewise can be transferred to special image-receiving layers to form a brilliant dye image which is not masked by troublesome image silver or silver halide and, hence, does not require any aftertreatment. Accordingly, the combination of the thermal development process with the dye diffusion process would create an advantageous rapid process for the production of colored images. A recording material suitable for this process is described, for example, in DE-AS No. 32 15 485.

According to this publication, a recording material comprising a layer containing a combination of silver halide, silver benzotriazolate, a dye-releasing compound and guanidine trichloroacetate (base donor) in a hydrophobic binder is exposed imagewise and then subjected to a heat treatment in contact with an image-receiving sheet, the dye exposed imagewise being transferred to the image-receiving sheet. The production of multicolored images requires the presence of several such combinations, the silver halide in each of these combinations being sensitive to a different spectral region of the light and, corresponding to its spectral sensitivity, containing a dye-releasing compound which releases a dye of another color, generally a color which is complementary to the color of the light to which the silver halide in question is predominantly sensitive. Associations such as these may be arranged one above the other in various layers.

The dye images obtained with the known thermally developable color photographic recording material show somewhat low maximal color densities and high fogging. Neither is the recording materials satisfactory in regard to sensitivity.

Accordingly, the object of the present invention is to provide a color photographic recording material which is further improved both in regard to the Dmin/Dmax relation and in regard to sensitivity.

The present invention relates to a color photographic recording material comprising at least one photosensitive silver halide emulsion layer applied to a layer support and at least one non-diffusing color providing compound which is associated with the silver halide emulsion layer and contains at least one binder layer which is either a photosensitive silver halide emulsion layer or is adjacent such a layer and which contains a homopolymer or copolymer containing recurring units of a polymerized monomer M, characterized in that the monomer M contains at least one urethane and/or urea group and in that, in addition to the recurring units of the polymerized monomer M, the copolymer contains recurring units of at least one other monomer C which is copolymerizable with the monomer M and which, in polymerized form, is not capable of producing a dye under the photographic processing conditions.

In one preferred embodiment, the monomer M corresponds to at least one of the following formulae I to III

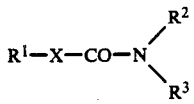

I

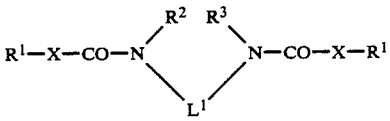

II

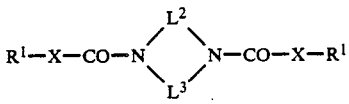

III in which

X represents —O—, —$NR_4$— and $R^1$ to $R^4$ may be the same or different and represent hydrogen, alkyl containing from 1 to 20 carbon atoms, cycloalkyl, aryl, aralkyl or a heterocyclic radical and in which $R^2$ and $R^3$ or $R^2$ and $R^4$ and/or $R^3$ and $R^4$ together may represent the radical required to form a heterocyclic group and at least one of $R^1$, $R^2$, $R^3$ and $R^4$ contains an ethylenically unsaturated, copolymerizable group;

$L^1$ represents alkylene, arylene or aralkylene containing at most 18 C-atoms and $L^2$ and $L^3$ may be the same or different and represent alkylene containing at most 10 C-atoms.

The alkyl, cycloalkyl, aryl, aralkyl and heterocyclic groups represented by $R^1$ to $R^4$ and also the alkylene, arylene and aralkylene groups represented by $L^1$, $L^2$ and $L^3$ may optionally be further substituted.

In one preferred embodiment, the radicals $R^1$ to $R^4$ containing an ethylenically unsaturated group are characterized by the following formula:

$$-L^4-(Y)_m-\overset{\overset{R^5}{|}}{C}=CH_2 \qquad \text{IV}$$

in which $L^4$ represents an ordinary organic bond, more especially an optionally substituted alkylene, arylene or aralkylene group containing at most 18 C-atoms, Y represents a difunctional bond containing at least one heteroatom, more especially —O—CO—, —CO—O—, —$NR^6$—CO— or —CO—$NR^6$— (where $R^6$ is hydrogen or alkyl, more especially containing from 1 to 4 carbon atoms), m=0 or 1 and $R^5$ represents hydrogen, alkyl, more especially containing from 1 to 4 C-atoms, or halogen, more especially chlorine.

Substituents for the alkyl, aralkyl or aryl groups represented by $R^1$ to $R^4$ or the alkylene, aralkyl or phenylene groups represented by $L^1$ to $L^4$ comprise aryl (for example a phenyl group), nitro, hydroxy, cyano, sulfo, alkoxy (for example a methoxy group), aryloxy (for example a phenoxy group), acyloxy (for example an acetoxy group), acylamino (for example an acetylamino group), sulfonamido (for example a methane sulfonamido group), sulfamoyl (for example a methylsulfamoyl group), halogen (for example a fluorine atom, a chlorine atom, a bromine atom), carboxy, carbamoyl (for example a methylcarbamoyl group), alkoxycarbonyl (for example a methoxycarbonyl group) and sulfonyl (for example a methylsulfonyl group). Where two or more substituents are present, they may be the same or different.

The monomer M is preferably free from groups which are capable of producing a dye, particularly a diffusible dye, under the photographic processing conditions.

The following are examples of monomers M:

$$CH_2=\overset{\overset{CH_3}{|}}{C}-COO-CH_2-CH_2-NH-CO-NH-C_4H_9 \qquad \text{M1}$$

$$CH_2=\overset{\overset{CH_3}{|}}{C}-COO-CH_2-CH_2-NH-CO-NH-C_2H_5 \qquad \text{M2}$$

$$CH_2=CH-COO-CH_2-CH_2-O-CO-NH-C_3H_7 \qquad \text{M3}$$

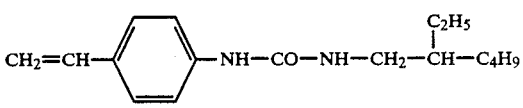

M4

$$CH_2=CH-CH_2-NH-CO-NH_2 \qquad \text{M5}$$

$$CH_2=\overset{\overset{CH_3}{|}}{C}-COO-CH_2-CH_2-CH_2-O-\overset{\overset{O}{\|}}{C}-NH-CH_3 \qquad \text{M6}$$

$$CH_2=\overset{\overset{CH_3}{|}}{C}-CO-NH-CH_2-CH_2-CH_2-CH_2-\overset{\overset{H}{|}}{N}-CO-NH_2 \qquad \text{M7}$$

$$CH_2=CH-CO-NH-CH_2-CH_2-CH_2-O-\overset{\overset{O}{\|}}{C}-NH-C_{12}H_{25} \qquad \text{M8}$$

$$CH_2=CH-COO-CH_2-CH_2-NH-CO-\overset{\overset{CH_3}{|}}{N}-CH_2-CH_2-OH \qquad \text{M9}$$

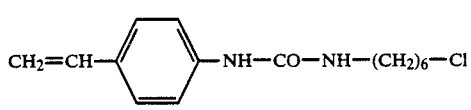

M10

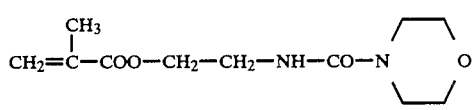

M11

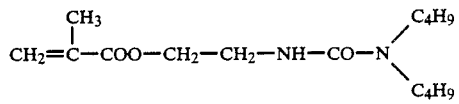

M12

$$CH_2=\overset{\overset{CH_3}{|}}{C}-COO-CH_2-CH_2-NH-CO-NH_2 \qquad \text{M13}$$

$$CH_2=\overset{\overset{CH_3}{|}}{C}-COO-CH_2-CH_2-NH-CO-NH-CH_2-CH=CH_2 \qquad \text{M14}$$

-continued
M15
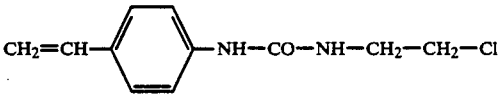
M16
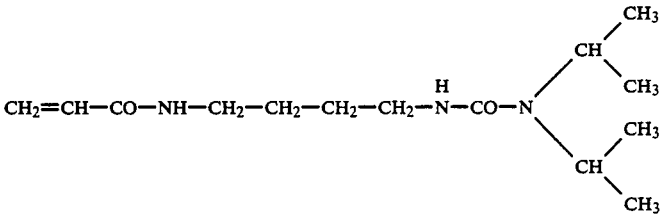
M17
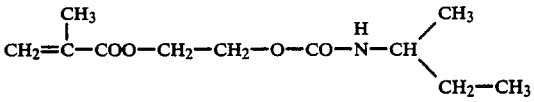
M18
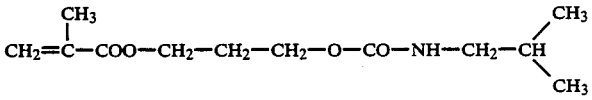
M19
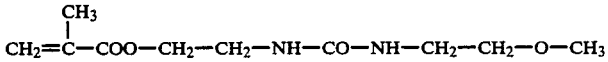
M20
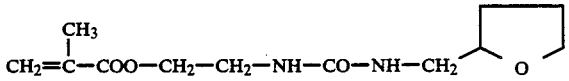
M21
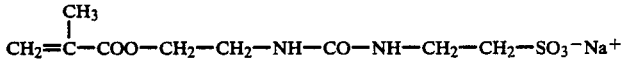
M22
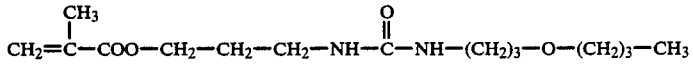
M23
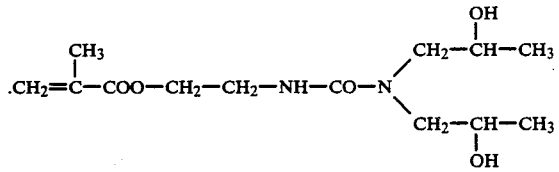
M24
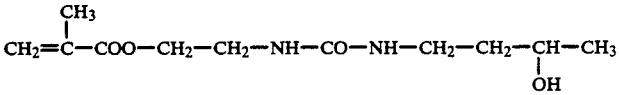
M25
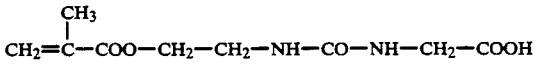
M26
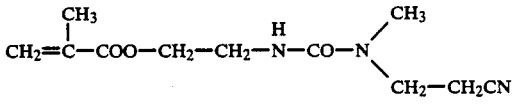
M27
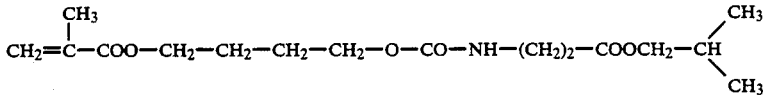
M28
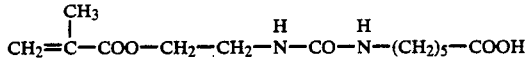

-continued
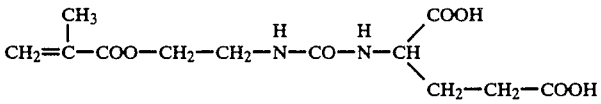
M29
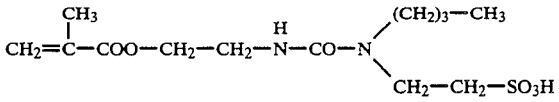
M30
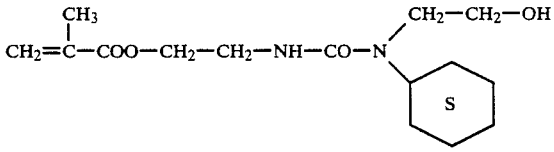
M31
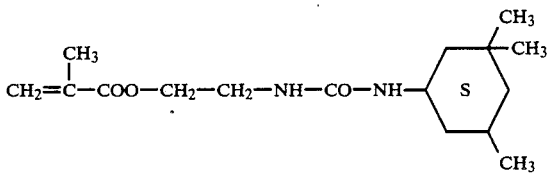
M32
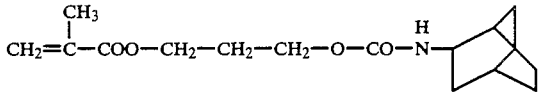
M33
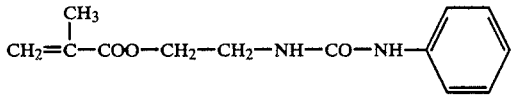
M34
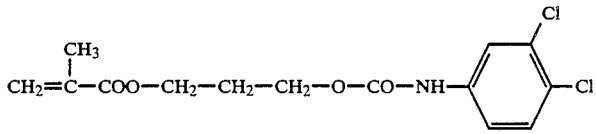
M35
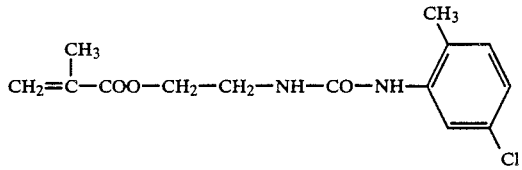
M36
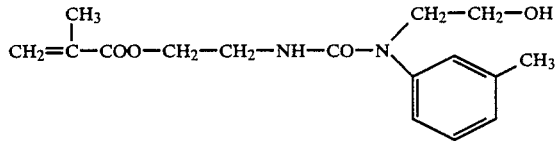
M37
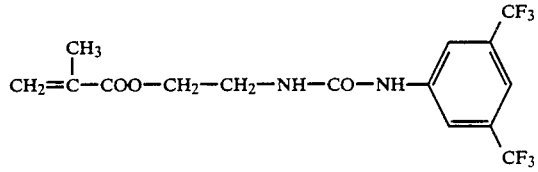
M38
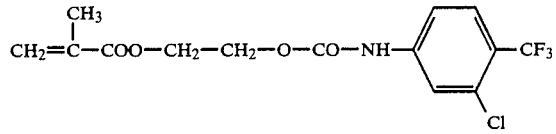
M39

-continued
M40
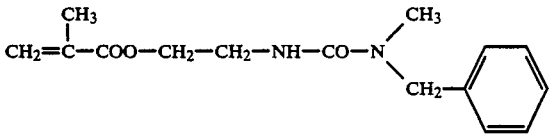
M41
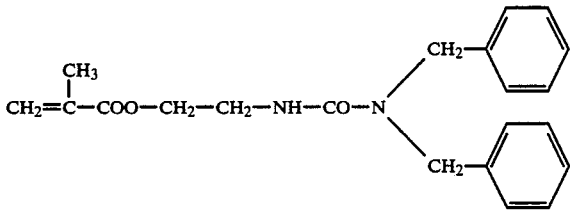
M42
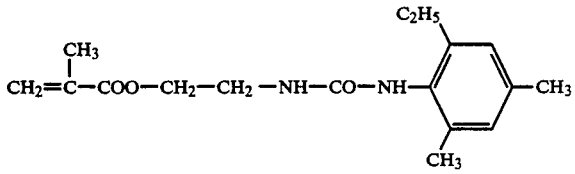
M43
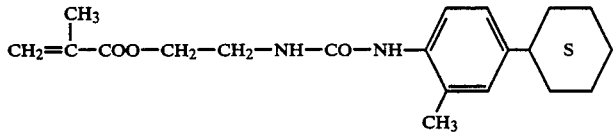
M44
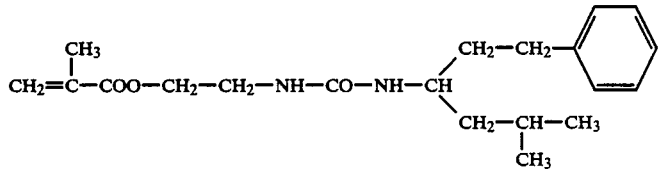
M45
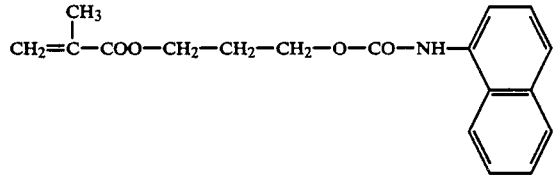
M46
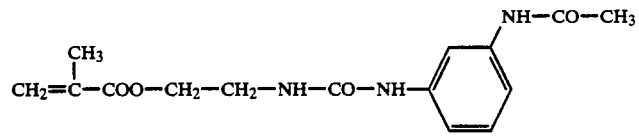
M47
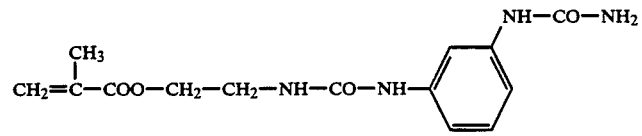
M48
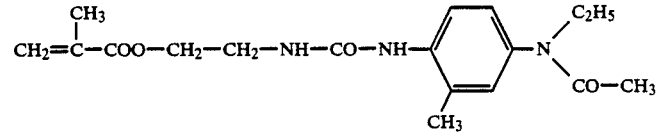

-continued
M49
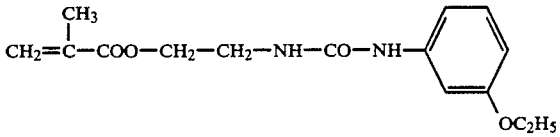
M50
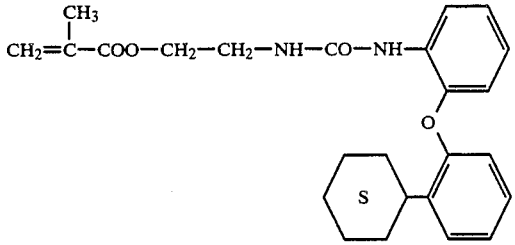
M51
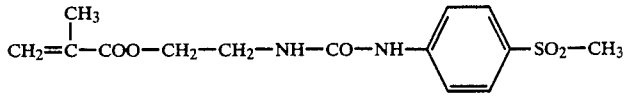
M52
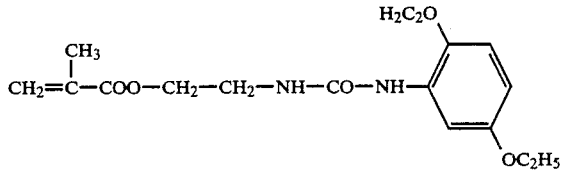
M53
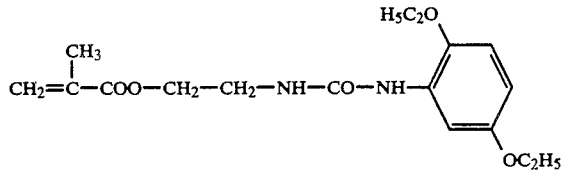
M54
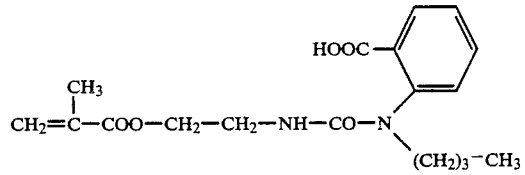
M55
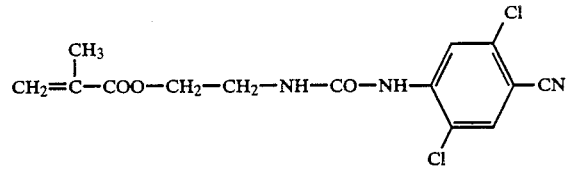
M56
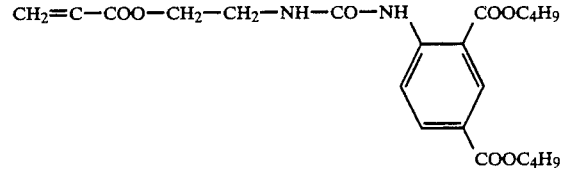
M57
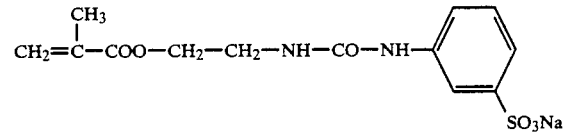

-continued
M58
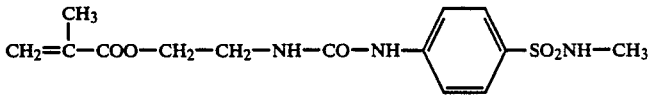
M59
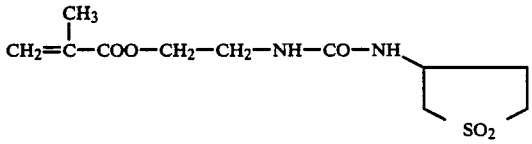
M60
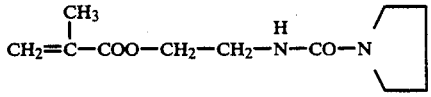
M61
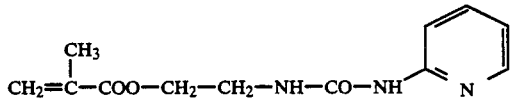
M62
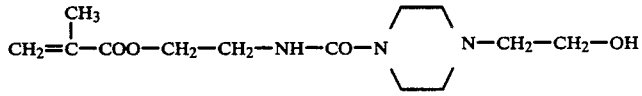
M63
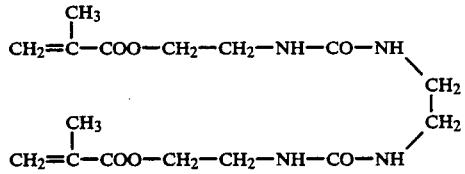
M64
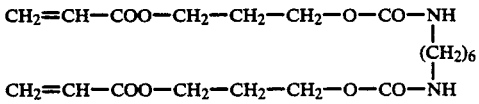
M65
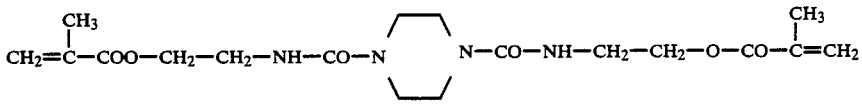
M66
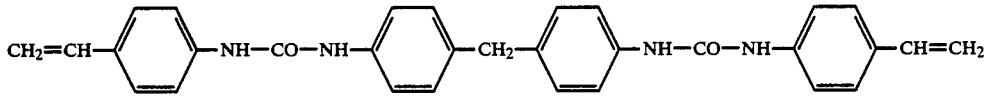
M67
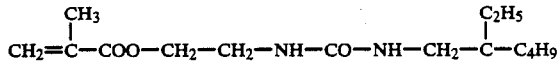
M68
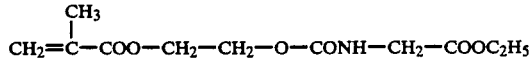
M69
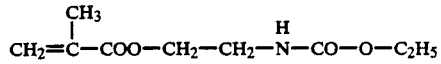
M70
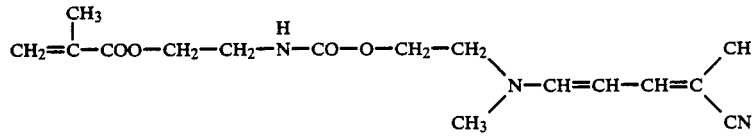
M71
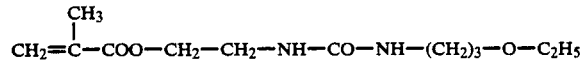

-continued

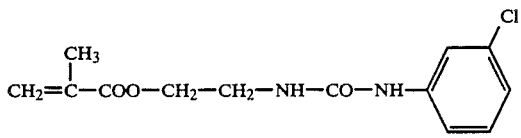

M72

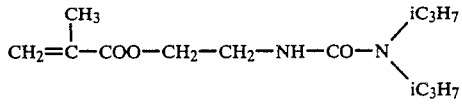

M73

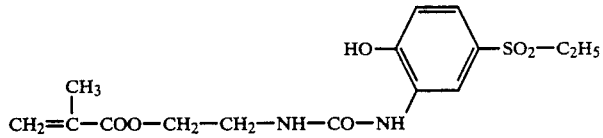

M74

The rings marked "S" are saturated rings.

The monomers M may be produced, for example, by reaction of a monomer containing isocyanate groups with a compound containing amino or hydroxyl groups. Another possibility is to react monomers containing an amino group with a chloroformic acid ester. However, it is also possible to start out from a compound already containing a urea or urethane group and to react it with a reactive monomer.

A few synthesis reactions for some of the monomers listed are shown in the following scheme:

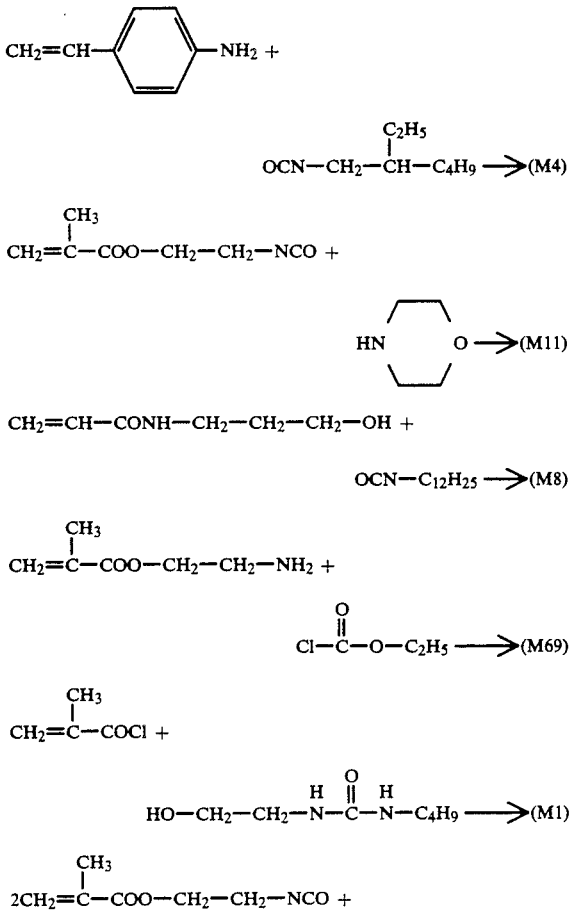

-continued

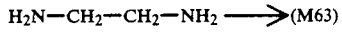

The synthesis of M1 and M70 as examples of a urea or a urethane monomer is described in the following.

Monomer M1

7.3 g n-butylamine are dissolved in 20 ml i-octane and the resulting solution cooled to 0° C. 14.1 g isocyanatoethylmethacrylate cyanatoethylmethacrylate are slowly added dropwise at 0°-5° C. The reaction mixture is then diluted with 20 ml i-octane and stirred for 15 minutes. The product precipitating is filtered off under suction, washed with i-octane and dried.

Yield 80%, Mp. 59° C.

MONOMER M70

36 g 3-(N-methyl-N-2-hydroxyethyl)-aminoallylidene malonitrile are stirred with 31 g isocyanatoethylmethacrylate in 250 ml ethylacetate for 3 hours at 25°-30° C. in the presence of 1 g 1,4-diazabicyclo-[2,2,2]-octane and 0.5 g ionol (2,6-di-tert.-butyl-4-methylphenol) and left standing overnight. The solution is concentrated in vacuo, the yellowish residue is dissolved in 70 ml methanol at 30° C. with addition of 0.5 g ionol and then cooled to 0° C. The deposit is filtered off and dried in vacuo at room temperature. 34 g of a yellowish product melting at 73° to 74° C. are obtained.

In addition to the recurring units of the monomer M, the copolymers according to the invention contain recurring units of at least one other copolymerized monomer C. Examples of these comonomers C include esters and amides of acrylic acid and derivatives thereof, for example of acrylic acid, α-chloroacrylic acid, methacrylic acid (for example acrylamide, methylmethacrylate, ethylacrylate, ethylmethacrylate, n-propylacrylate, n-butylacrylate, 2-ethylhexylacrylate, n-hexylacrylate, octylmethacrylate, laurylmethacrylate and methylene-bis-acrylamide), vinyl esters (for example vinyl acetate, vinyl propionate and vinyl laurate), acrylonitrile, methacrylonitrile, aromatic vinyl compounds (for example styrene, vinyl toluene, divinyl benzene, vinyl acetophenone, styrene sulfonic acid), itaconic acid, citraconic acid, crotonic acid, vinylidene chloride, a vinyl alkylether (for example vinyl ethylether), esters of maleic acid, N-vinyl-2-pyrrolidone, N-vinyl-, 2-vinyl- and 4-vinyl-pyridine.

The molecular weights of the polymers according to the invention are preferably greater than 5000 and more preferably greater than 20,000. The upper limit is not critical and may reach values of more than 10 million, particularly where bifunctional or polyfunctional monomers are used as the additional comonomer C.

Of the comonomers C, it is particularly preferred to use an ester of acrylic or methacrylic acid and/or an aromatic vinyl compound.

Two or more of the above-described comonomers C may be used with one another. For example, it is possible to use a combination of n-butylacrylate and divinylbenzene, styrene and methylmethacrylate, methylacrylate and methacrylic acid.

The ethylenically unsaturated comonomer C may be selected so that it has a favorable effect upon the physical properties and/or chemical properties of the copolymer to be produced, for example its solubility, compatibility with a binder, such as gelatin, or other photographic additives, such as color providing compounds, UV-absorbers, antioxidants and the like, and also upon the flexibility and thermal stability of the layer compositions or rather the color photographic recording materials.

Examples of polymers according to the invention are given in the following:

P 1

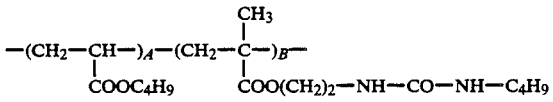

A/B: 50/50 (% by weight)

P 2

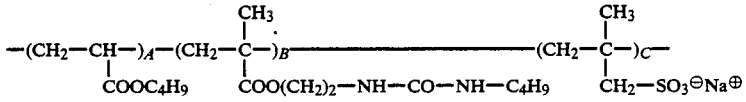

A/B/C: 49/49/2 (% by weight)

P 3

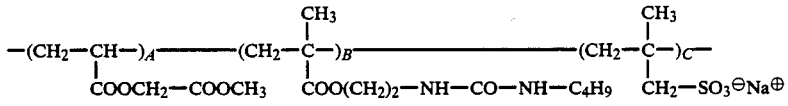

A/B/C: 49/49/2 (% by weight)

P 4

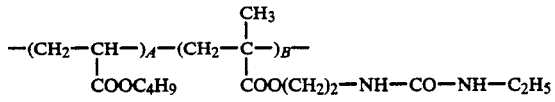

A/B: 50/50 (% by weight)

P 5

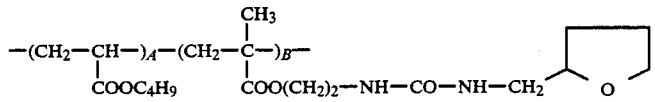

A/B: 60/40 (% by weight)

P 6

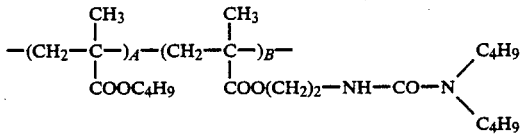

A/B: 65/35 (% by weight)

P 7

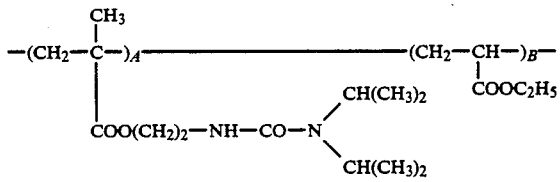

A/B: 30/70 (% by weight)

P 8

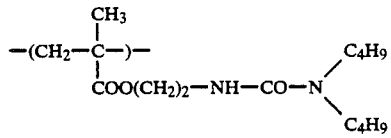

P 9

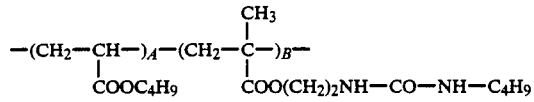

-continued

A/B: 90/10 (% by weight)

P 10

Same as P 9, but with A/B=70/30 (% by weight).

P 11

Same as P 9, but with A/B=30/70 (% by weight).

In a preferred embodiment, the polymers according to the invention are used in the form of a polymer dispersion or polymer latex. A polymer dispersion of the type in question may be prepared, for example, by an emulsion polymerization process or by polymerization in an organic solvent and subsequent dispersion of the resulting latex or the solution in latex form in an aqueous solution of gelatin.

The polymerization of the ethylenically unsaturated monomers is generally initiated by free radicals which are formed by thermal decomposition of a chemical initiator, by the action of a reducing agent on an oxidizing compound (redox initiator) or by a physical effect, such as irradiation with ultraviolet light or other high-energy radiation, high frequencies, etc.

Examples of chemical initiators include a persulfate (for example ammonium persulfate or potassium persulfate, etc.), a peroxide (for example hydrogen peroxide, benzoyl peroxide or tert.-butyl peroctoate, etc.) and an azonitrile compound (for example 4,4'-azo-bis-4-cyanovaleric acid and azo-bis-isobutyronitrile, etc.).

Examples of conventional redox initiators include hydrogen-peroxide-iron(II) salt, potassium persulfate, sodium metabisulfite and cerium(IV)-salt-alcohol, etc.

Examples of the initiators and their functions are described by F. A. Bovey in Emulsion Polymerization, Interscience Publishers Inc., N.Y., 1955, pages 59 to 93.

A surface-active compound may be used as emulsifier for the emulsion polymerization. Preferred examples are soaps, sulfonates, sulfates, cationic compounds, amphoteric compounds and high molecular weight protective colloids. Specific examples of the emulsifiers and their functions can be found in Belgische Chemische Industrie, Vol. 28, pages 16 to 20, 1963.

Any organic solvent used in the preparation of the polymer or during dispersion of the polymer in an aqueous gelatin solution may be removed from the casting solution before casting. Suitable solvents are, for example, those which are soluble in water to a certain extent, so that they may readily be removed in the form of gelatin noodles by washing with water, and those which may be removed by spray drying, vacuum or steam purging.

Examples of solvents of the type in question include esters (for example ethylacetate), ethers, ketones, halogenated hydrocarbons (for example methylene chloride, trichloroethylene), alcohols (for example methanol, ethanol, butanol) and combinations thereof.

Suitable photosensitive silver halide emulsions for the color photographic recording materials according to the invention are emulsions of silver chloride, silver bromide or mixtures thereof, optionally containing up to 40 mole % silver iodide, in one of the hydrophilic binders normally used. Gelatin is preferably used as binder for the photographic layers. However, it may be completely or partly replaced by other natural or synthetic binders.

In the production of the recording material according to the invention for the thermal development process, a substantially non-photosensitive silver salt may be added to the photosensitive silver halide. In this case, for example, the quantity of photosensitive silver halide in the particular layer may be between 0.01 and 5.0 $g/m^2$ and preferably between 0.1 and 1.0 $g/m^2$ In some cases, the quantity of silver halide used is nearer the lower end of the range indicated on account of its catalytic function (as exposed silver halide).

The substantially non-photosensitive silver salt may be, for example, a comparatively light-stable silver salt, for example an organic silver salt. Suitable silver salts are the silver salts of aliphatic or aromatic carboxylic acids and also the silver salts of nitrogen-containing heterocycles. Silver salts of organic mercapto compounds may also be used.

Preferred examples of silver salts of aliphatic carboxylic acids are silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate or silver butyrate. The carboxylic acids on which the silver salts are based may be substituted, for example, by halogen atoms, hydroxyl groups or thioether groups.

Examples of silver salts of aromatic carboxylic acids and other compounds containing carboxyl groups are silver benzoate, silver-3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenylacetate, silver pyromellitate, silver salts of 3-carboxymethyl-4-methyl-4-thiazolin-2-thione or similar heterocyclic compounds. Other suitable silver salts are silver salts of organic mercaptans, for example the silver salts of 3-mercapto-4-phenyl-1,2,4-triazole, 2-mercaptobenzimidazole, 2-mercaptobenzothiazole, 2-mercaptobenzoxazole, 2-mercaptooxadiazole, mercaptotriazine, thioglycolic acid, and also the silver salts of dithiocarboxylic acids, such as for example the silver salt of dithioacetate.

The silver salts of compounds containing an imino group are also suitable. Preferred examples include the silver salts of benzotriazole and derivatives thereof, for example silver salts of alkyl- and/or halogen-substituted benzotriazoles, such as for example the silver salts of methylbenzotriazole, 5-chlorobenzotriazole, and also the silver salts of 1,2,4-triazole, 1-H-tetrazole, carbazole, saccharin and silver salts of imidazole, benzimidazole and derivatives thereof.

According to the invention, the quantity in which the substantially non-photosensitive silver salt is used in the particular layer is from 0.01 to 5 $g/m^2$. The substantially non-photosensitive silver salt and the photosensitive silver halide may be present alongside one another as separate particles or may even be present in a combined form produced, for example, by treating a substantially non-photosensitive silver salt in the presence of halide ions, in which case photosensitive centers of photosensitive silver halide are formed by conversion on the surface of the particles from the substantially non-photosensitive silver salt. Reference is made in this connection to U.S. Pat. No. 3,457,075.

The substantially non-photosensitive silver salt acts as a reservoir for metal ions which, where a reducing agent is present during the thermal development process, are reduced to elemental silver under the catalytic effect of the silver halide exposed imagewise and which themselves serve as oxidizing agents (for the reducing agent present).

The emulsions may be chemically and/or spectrally sensitized in the usual way and the emulsion layers and also other non-photosensitive layers may be hardened with known hardeners in the usual way.

Color photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or in known manner, for example in the so-called double layer arrangement, may also comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer the layer support than blue-sensitive silver halide emulsion layers, a non-photosensitive yellow filter layer generally being present between green-sensitive layers and blue-sensitive layers. However, other arrangements are also possible. In general, a non-photosensitive intermediate layer which may contain agents for preventing the erroneous diffusion of developer oxidation products is arranged between layers of different spectral sensitivity. Where several silver halide emulsion layers of the same spectral sensitivity are present, they may be immediately adjacent one another or arranged in such a way that a photosensitive layer of different spectral sensitivity is present between them (DE-A-1 958 709, DE-A-2 530 645, DE-A-2 622 922).

Color photographic recording materials for producing multicolored images normally contain color providing compounds, for example color couplers or dye-releasing compounds, for producing the various component color images cyan, magenta and yellow, in spatial and spectral association with the silver halide emulsion layers of different spectral sensitivity.

In the context of the invention, spatial association is understood to mean that the color-providing compound is in such a spatial relationship with the silver halide emulsion layer that they are able to interact with one another in such a way as to permit imagewise consistency between the silver image formed during development and the dye image produced from the color-providing compound. To this end, the color-providing compound is generally present in the silver halide emulsion layer itself or in an adjacent, optionally non-photosensitive binder layer.

In the context of the invention, spectral association is understood to mean that the spectral sensitivity of each of the photosensitive silver halide emulsion layers and the color of the component color image produced from the particular spatially associated color-providing compound bear a certain relationship to one another, another color of the component color image in question (generally for example the colors cyan, magenta and yellow in that order) being associated with each of the spectral sensitivities (red, green, blue).

One or even several color-providing compounds may be associated with each of the differently spectrally sensitized silver halide emulsion layers. Where several silver halide emulsion layers of the same spectral sensitivity are present, each of them may contain a dye-producing compound; the color-providing compounds in question do not necessarily have to be the same. They are merely required to produce at least approximately the same color during color development, normally a color which is complementary to the color of the light to which the silver halide emulsion layers in question are predominantly sensitive.

In preferred embodiments, therefore, at least one non-diffusing color-providing compound for producing the cyan component color image is associated with red-sensitive silver halide emulsion layers. At least one non-diffusing color-providing compound for producing the magenta component color image is associated with green-sensitive silver halide emulsion layers. Finally, at least one non-diffusing color-providing compound for producing the yellow component color image is associated with blue-sensitive silver halide emulsion layers.

The color-providing compounds may be standard color couplers from which the image dyes are formed by a standard chromogenic development process. In one preferred embodiment of the invention, however, the color-providing compounds used are so-called dye-releasing compounds from which diffusible dyes are released imagewise during processing under alkaline conditions and may be transferred to a suitable image-receiving layer to form a colored transfer image. In this connection, particular preference is attributed to those embodiments of the invention in which the image-producing processing is carried out by heat treatment, generally after imagewise exposure.

The dye-releasing compounds used in this embodiment of the invention may be any of various types of compounds which are all distinguished by a bond which is redox-dependent in its binding strength and which attaches a dye residue to a carrier residue containing a ballast radical.

In this connection, reference is made to a comprehensive report on the subject in question in Angew. Chem. Int. Ed. Engl. 22 (1983), 191–209 in which the most important of the known systems are described.

Redox-active dye-releasing compounds corresponding to the following formula

BALLAST—REDOX—DYE, in which

BALLAST represents a ballast radical,

REDOX represents a redox-active group, i.e. a group which is oxidizable or reducible under the alkaline development conditions and which undergoes an elimination reaction, a nucleophilic displacement reaction, a hydrolysis or other decomposition reaction to varying degrees, depending on whether it is present in oxidized or reduced form, with the result that the DYE residue is split off and DYE represents the residue of a diffusible dye, for example a yellow, magenta or cyan dye, or the residue of a dye precursor, have proved to be particularly advantageous.

Ballast radicals are regarded as radicals which enable the dye-releasing compounds according to the invention to be incorporated in non-diffusing form in the hydrophilic colloids normally used in photographic materials. Preferred radicals of this type are organic radicals which generally contain straight-chain or branched chain aliphatic groups with generally from 8 to 20 C-atoms and, optionally, also carbocyclic or heterocyclic, optionally aromatic groups. These radicals are generally attached to the rest of the molecule either directly or indirectly, for example by one of the following groups: —NHCO—, —$NHSO_2$—, —NR—, where R is hydrogen or alkyl, —O— or —S—. In addition, the ballast radical may also contain water-solubilizing groups, such as for example sulfo groups or carboxyl groups, which may also be present in anionic form. Since the diffusion properties depend on the size of the molecule of the overall compound used, it is sufficient in certain cases, for example where the overall molecule is large enough, to use even relatively short-chain radicals as the ballast radicals.

Redox-active carrier residues of the structure BALLAST-REDOX and corresponding dye-releasing compounds are known in various different forms. There is no need to provide a detailed description here in the light of the above-mentioned synoptic article in Angew. Chem. Int. Ed. Engl. 22 (1983) 191–209.

Some examples of redox-active carrier residues, from which a dye residue is split off providing imagewise oxidation or reduction has occurred, are given in the following purely by way of illustration:

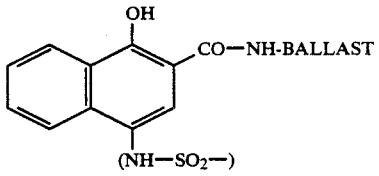

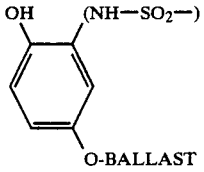

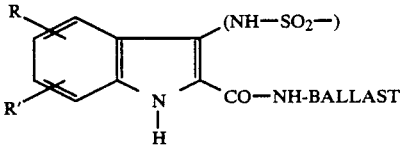

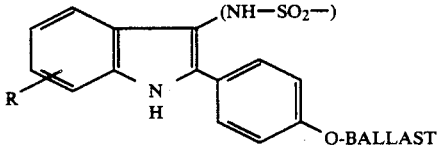

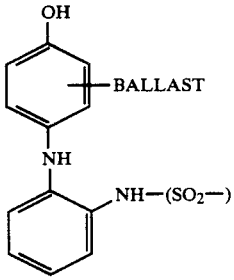

-continued

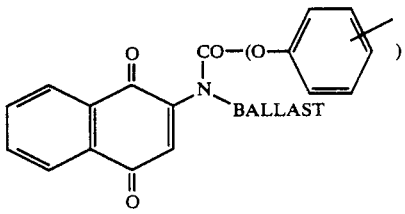

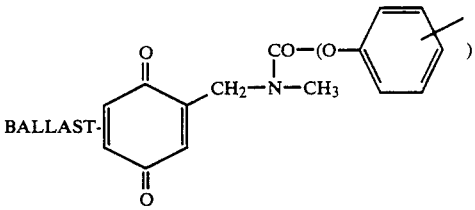

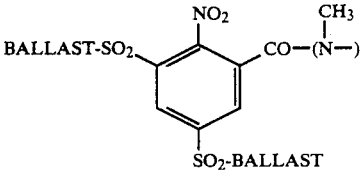

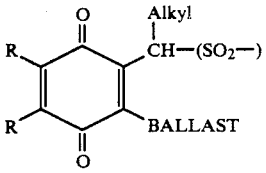

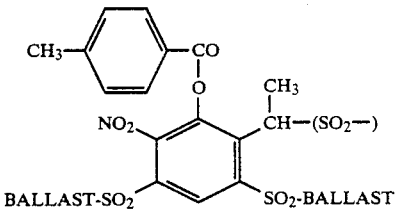

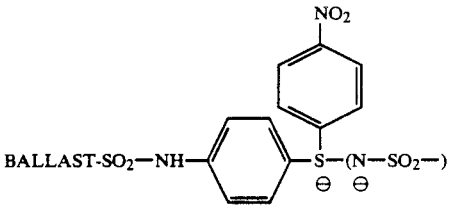

The groups shown in brackets are functional groups of the dye residue and are separated together with the dye residue from the remaining part of the carrier residue. The functional group may be a substituent which may have a direct influence on the absorption and, optionally, complexing properties of the dye released. On the other hand, however, the functional group may even be separated from the chromophore of the dye by an intermediate member or bond. Finally, the functional group may also be of significance, optionally in conjunction with the intermediate member, to the diffusion, mordanting and stability behavior of the dye released. Suitable intermediate members are, for example, alkylene or arylene groups.

Suitable dye residues are, basically, the residues of dyes of any type, providing they are sufficiently diffusible to be able to diffuse from the photosensitive layer of the photosensitive material into an image-receiving layer. To this end, the dye residues may be provided with one or more alkali-solubilizing groups. Suitable alkali-solubilizing groups are inter alia carboxyl groups, sulfo groups, sulfonamide groups and also aromatic hydroxyl groups. Alkali-solubilizing groups such as these may actually be preformed in the dye-releasing compounds or may result from release of the dye residue from the carrier residue containing ballast groups. Suitable dyes are azo dyes, azomethine dyes, anthraquinone dyes, phthalocyanine dyes, indigoid dyes, triphenylmethane dyes, including dyes which are complexed or which may be complexed with metal ions.

Residues of dye precursors are understood to be the residues of compounds which are converted into dyes during photographic processing, particularly under the heat development conditions, whether by oxidation, by coupling, by complexing or by the exposure of an auxochromic group in a chromophoric system, for example by hydrolysis. Dye precursors in this sense may be leuco dyes, couplers or even dyes which are converted into other dyes during processing. Unless a distinction between dye residues and the residues of dye precursors is crucially important, the latter are also to be understood hereinafter as dye residues.

Suitable dye-releasing compounds are described, for example in: U.S. Pat. Nos. 3,227,550, 3,443,939, 3,443,940, DE-A-No. 19 30 215, 22 42 762, 24 02 900, 24 06 664, 25 05 248, 25 43 902, 26 13 005, 26 45 656, 28 09 716, 28 23 159, BE-A-861 241, EP-A-0 004 399, EO-A-0 004 400, DE-A-No. 30 08 588, 30 14 669, GB-A-80 12 242.

In some embodiments of the recording material according to the invention, the dye-releasing compounds may be present as oxidizable or couplable dye-releasing compounds, in others as reducible dye-releasing compounds. Depending on whether the dye is released from the oxidized form or from the reduced form of the dye-releasing compounds, a negative or positive copy of the original is obtained where standard negative silver halide emulsions are used. Accordingly, positive or negative images may be produced as required by choosing suitable dye-releasing compounds.

Particularly suitable oxidizable dye-releasing compounds for the recording materials according to the invention are described, for example, in DE-A-26 45 656.

Where the dye-releasing compound is oxidizable, it does itself represent a reducing agent which is oxidized either directly or indirectly with the aid of electron transfer agents (ETA) by the silver halide exposed imagewise or by the substantially non-photosensitive silver salt under the catalytic effect of the silver halide exposed image-wise. In this case, an image-wise distinction emerges in regard to the ability to release the diffusible dye. If, on the other hand, the dye-releasing compound is reducible, it is best used in combination with a reducing agent present in a limited quantity, a so-called electron donor compound or an electron donor precursor compound, which in this case is contained in the same binder layer as the dye-releasing compound, the photosensitive halide and, optionally, the substantially non-photosensitive silver salt. The presence of electron transfer agents may also be of advantage in cases where reducible dye-releasing compounds are used in combination with electron donor compounds.

For example, a recording material according to the invention containing reducible dye-releasing compounds having carrier residues corresponding to the following formula

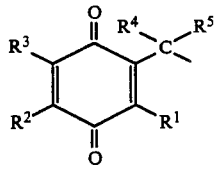

"carquin"

in which $R^1$ represents alkyl or aryl;

$R^2$ represent alkyl, aryl or a group which, together with $R^3$, completes a fused ring;

$R^3$ represents hydrogen, alkyl, aryl, hydroxyl, halogen, such as chlorine or bromine, amino, alkylamino-dialkylamino, including cyclic amino groups (such as piperidino, morpholino), acylamino, alkylthio, alkoxy, aroxy, sulfo or a group which, together with $R^2$, completes a fused ring;

$R^4$ represents alkyl;

$R^5$ represents alkyl or, preferably, hydrogen, at least one of the substituents $R^1$ to $R^4$ containing a ballast group, is suitable for producing positive color images of positive originals where negative silver halide emulsions are used.

The electron donor compound used in conjunction with a reducible dye-releasing compound also serves as a reducing agent for the silver halide, the substantially non-photosensitive silver salt and the dye-releasing compound. Because the substantially non-photosensitive silver salt and the dye-releasing compound so to speak compete with one another during the oxidation of the electron donor compound, although the former is always superior to the latter in the presence of exposed silver halide, the silver halide present—after image-wise exposure—determines those regions of the image in which the dye-releasing compound is converted into its reduced form by the electron donor compound.

Under the development conditions, for example on heating of the color photographic recording material exposed image-wise, and depending on the degree of exposure, the electron donor compound present in a limited quantity is oxidized by the substantially non-photosensitive silver salt and the photosensitive silver halide under the catalytic effect of the latent image neuclei produced by exposure in the silver halide and, accordingly, is no longer available for a reaction with the dye-releasing compound. The unused electron donor compound is so to speak distributed image-wise.

Electron donor compounds which have been described in the literature include, for example, non-diffusing or substantially non-diffusing derivatives of hydroquinone, benzisoxazolone, p-aminophenol or ascorbic acid, for example ascorbyl palmitate (DE-A-28 09 716).

Other examples of electron donor compounds are known from DE-A-29 47 425, DE-A-30 06 268, DE-A-31 30 842, DE-A-31 44 037, DE-A-32 17 877 and EP-A-0 124 915 and from Research Disclosure No. 24 305 (July 1984). It has been found that the electron donor compounds mentioned satisfy the demands made of them, even under heat development conditions, and accordingly are also suitable as electron donor compounds in the context of the present invention. Particularly suitable electron donor compounds are those which are only formed in the layer from corresponding electron donor precursor compounds under the thermal development conditions, i.e. electron donor compounds which, before development, are only present in the recording material in a masked form in which they are virtually inactive. Under the thermal development conditions, the initially inactive electron donor compounds are then converted into their active form, for example by the removal of certain protective groups through hydrolysis. In the present case, the electron donor precursor compounds mentioned may also be regarded as electron donor compounds.

According to the invention, the described polymer containing the recurring units of the monomer M containing urea or urethane groups is present in at least one binder layer, which may a photosensitive layer or a non-photosensitive layer, the binder in this layer preferably being a hydrophilic binder, for example gelatin. The polymer according to the invention is preferably used in a layer containing a color providing compound. By using the polymer according to the invention, the color density of the color image produced from the color-providing compounds may be distinctly increased. The quantity in which the polymer according to the invention is used is generally gauged in such a way that from 10 to 90% by weight of the binder consists of the polymer according to the invention and from 90 to 10% by weight of the hydrophilic layer binder. The layer preferably contains from 30 to 80% by weight of the polymer according to the invention. The optimal quantity may readily be determined by routine tests. A thickener, for example polystyrene sulfonic acid, may also be present, for example in a quantity of up to 5% by weight.

In addition to the essential constituents already mentioned, the color photographic recording material according to the invention may contain other constituents and auxiliaries which, for example in the case of the thermal development process, facilitate the heat treatment and the accompanying dye transfer. These other constituents and auxiliaries may be present in a photosensitive layer or in a non-photosensitive layer.

Auxiliaries of the type in question are, for example, auxiliary developers. These auxiliary developers generally have developing properties for exposed silver halide. In the present case, they have above all a promoting effect on the reactions taking place between the exposed silver salt (=silver salt in the presence of exposed silver halide) and the reducing agent. Where oxidizable dye-releasing compounds are used, the reducing agent is identical with those compounds; where reducible dye-releasing compounds are used, the reducing agent reacts with the dye-releasing compound. Since this reaction mainly involves a transfer of electrons, the auxiliary developers are also called electron transfer agents (ETA).

Examples of suitable auxiliary developers are hydroquinone, pyrocatechol, pyrogallol, hydroxylamine, ascorbic acid, 1-phenyl-3-pyrazolidone and derivatives thereof. Because the auxiliary developers also have a catalytic function, they do not have to be present in stoichiometeric quantities. In general, it is sufficient for them to be present in the layer in quantities of up to at most ½ mole per mole of dye-releasing compound. They may be incorporated in the layer, for example, from solutions in water-soluble solvents or in the form of aqueous dispersions obtained using oil formers.

Other auxiliaries are, for example, basic substances or compounds which are capable of making basic substances available under the effect of the heat treatment. Auxiliaries such as these are, for example, sodium hydroxide, potassium hydroxide, calcium hydroxide, sodium carbonate, sodium acetate and organic bases, particularly amines, such as alkylamines, pyrrolidine, piperidine, amidine, guanidine and salts thereof, more especially salts with thermally decomposable aliphatic carboxylic acids, such as trichloroacetates for example. By making the basic substances available, a suitable alkaline medium is created during the heat treatment in the photosensitive layer and the adjoining layers to guarantee the release of the diffusible dyes from the dye-releasing compounds and their diffusion into the image-receiving layer.

Other auxiliaries are, for example, compounds which are capable of releasing water under the effect of heat. Compounds such as these are, in particular, inorganic salts containing water of crystallization, for example $Na_2SO_4 \cdot 10H_2O$, $NH_4Fe(SO_4)_2 \cdot 12H_2O$, and also compounds of the sodium benztriazolate type which crystallize as a complex containing varying amounts of water (up to 24 moles $H_2O$) and which are described in U.S. Pat. No. 4,418,139. The water released during heating promotes the development and diffusion processes required for image production.

Further auxiliaries are, for example, the so-called thermal solvents or development and diffusion promoters, which are generally understood to be non-hydrolyzable organic compounds which are solid or liquid under normal but which - at the heat treatment temperature conditions, provide a liquid medium in which the development and diffusion processes can take place more quickly. Preferred examples of auxiliaries such as these are polyglycols, of the type described for example in U.S. Pat. No. 3,347,675, for example polyethylene glycol having an average molecular weight of from 1500 to 20,000, derivatives of polyethylene oxide, such as for example its oleic acid ester, beeswax, monostearin, compounds having a high dielectric constant and containing an —$SO_2$— or —CO— group, such as for example acetamide, lactams, succinamide, ethylcarbamate, urea, methylsulfonamide; polar substances of the type described in U.S. Pat. No. 3,667,959, the lactone of 4-hydroxybutyric acid, dimethylsulfoxide, tetrahydrothiophene-1,1-dioxide and 1,10-decane diol, methyl anisate, biphenylsuberate, etc., also water, ethylene glycol, glycerol and other solvents having a good solubilizing effect.

In the case of the thermal development process for example, development of the color photographic recording material according to the invention exposed image-wise comprises the steps of silver halide development, producing an image-wise distribution of diffusible dyes and the diffusion transfer of this image-wise distribution to the image-receiving layer. It is initiated by subjecting the exposed recording material to a heat treatment in which the photosensitive binder layer is heated for about 0.5 to 300 s to an elevated temperature, for example to a temperature of from 80° to 250° C. In this way, suitable conditions for the development processes, including dye diffusion, are created in the recording material without any need for a liquid medium, for example in the form of a developer bath. During development, diffusible dyes are released image-wise from the dye-releasing compounds and are transferred to an image-receiving layer which is either an integral part of the color photographic recording material according to the invention or which is in contact therewith at least during the development time.

Accordingly, image-wise silver development, dye release and dye transfer take place synchronously in a one-step development process.

In addition, the production of colored images using the color photographic recording material according to the invention may also take place in a two-step development process, in the first step of which silver halide development and dye release take place at temperatures of from 80° to 250° C., after which the colored image is transferred in a second step from the photosensitive element to an image-receiving layer brought into contact therewith, for example by heating to a temperature of from 50° to 150° C. and preferably to a temperature of from 70° to 90° C.; in this case, diffusion aids (solvents), such as water for example, may be externally applied before lamination of the photosensitive element and the image-receiving layer.

Accordingly, the image-receiving layer may be arranged on the same layer support as the photosensitive element (single-sheet material) or on a separate layer support (two-sheet material). It consists essentially of a binder and a mordant for fixing the diffusible dyes released from the non-diffusing dye-releasing compounds. Preferred mordants for anionic dyes are long-chain quaternary ammonium or phosphonium compounds, for example of the type described in U.S. Pat. Nos. 3,271,147 and 3,271,148.

It is also possible to use certain metal salts and hydroxides thereof which form sparingly soluble compounds with the acidic dyes. Polymeric mordants, for example those described in DE-A-23 15 304, DE-A-26 31 521 or DE-A-29 41 818, may also be used. The dye mordants are dispersed in one of the usual hydrophilic binders in the mordant layer, for example in gelatin, polyvinyl pyrrolidone, completely or partially hydrolyzed cellulose esters. Many binders may of course also function as mordants, for example polymers of nitrogen-containing, optionally quaternary bases, for example of N-methyl-4-vinyl pyridine, 4-vinyl pyridine, 1-vinyl imidazole, as described for example in U.S. Pat. No. 2,484,430. Other suitable mordant binders are, for example, guanylhydrazone derivatives of alkyl vinyl ketone polymers, as described for example in U.S. Pat. No. 2,882,156, or guanylhydrazone derivatives of acyl styrene polymers, as described for example in DE-A-20 09 498. In general, however, other binders, for example gelatin, will be added to these mordant binders.

If the image-receiving layer remains in layer contact with the photosensitive element even after development, the two layers in question are generally separated by an alkali-permeable pigment-containing light-reflecting binder layer which provides optical separation between negative and positive and serves as an aesthetically attractive image background for the positive dye image to be transferred. If the image-receiving layer is arranged between the layer support and the photosensitive element and is separated from the latter by a preformed light-reflecting layer, either the layer support must be transparent so that the dye transfer image produced may be viewed through it or the photosensitive element must be removed together with the light-reflecting layer from the image-receiving layer in order to expose the image-receiving layer. However, the image-receiving layer may also be present as uppermost layer in an integral color photographic recording material, in which case the material is best exposed to light through the transparent layer support.

EXAMPLE 1

A photosensitive element of a photothermographic recording material for the diffusion transfer process was prepared by applying the layers described below to a transparent layer support of polyethylene terephthalate having a thickness of 175 μm. All the quantities indicated are based on 1 $m^2$; for silver halide, the corresponding quantity of silver (Ag) is quoted.

1. A green-sensitive layer comprising a green-sensitized silver halide emulsion (0.32 g Ag; 4 mole % AgCl; 88.7 mole % AgBr; 7.3 mole % AgI; average grain diameter 0.3 um) and silver benztriazolate (0.32 g Ag), 0.3 g of the color-providing compound A emulsified with 0.15 g diethyllauramide, 1.5 g gelatin and 1 g of polymer P 1 according to the invention.

2. A layer containing 1.5 g guanidine trichloro acetate (base donor), 0.24 g 4-methyl-4-hydroxymethyl phenidone (auxiliary developer), 0.06 g sodium sulfite (oxidation inhibitor), 0.03 g of compound B (wetting agent) and 1.5 g gelatin.

3. A protective layer of 0.5 g gelatin (hardener is applied with this protective layer).

The photosensitive element thus prepared is called sample 1. Further samples 2 to 4 were similarly prepared using polymers P 2, P 3 and P 4 according to the invention (1 g in each case) instead of polymer P 1 according to the invention. Another sample 5 received no addition while a further sample 6 received an addition of 1 g gelatin instead of a polymer according to the invention. The polymers according to the invention and comparison substances were added to the casting solution as aqueous dispersions.

Color-providing compound A

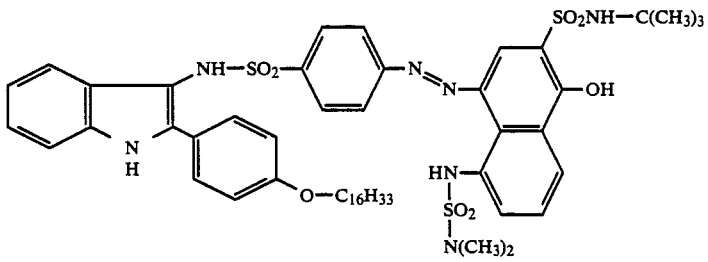

-continued

Compound B

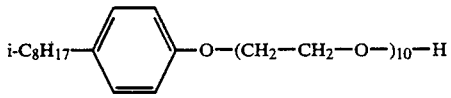

An image-receiving element for the dye diffusion transfer process was prepared by successively applying the following layers to a transparent layer support of polyethylene terephthalate. The quantities indicated are based on 1 $m^2$.

1. A mordant layer containing 2 g polyurethane mordant of 4,4'-diphenylmethane diisocyanate and N-ethyl diethanolamine quaternized with epichlorohydrin in accordance with DE-A-26 31 521, Example 1, 0.035 g compound B and 2 g gelatin.

2. A protective layer of 0.8 g gelatin (hardener was applied with this protective layer).

Processing

Samples of the photosensitive element (samples 1 to 6) were exposed through a step wedge. Development was carried out in two steps; in the first step, the photosensitive element was heated for 60 s at 120° C. Heating was carried out by means of a heating plate, the sample being applied to the heating plate on the layer side and being covered by another plate. In the second step, the sample was brought into contact with the image-receiving element on its layer side, the image-receiving element having been previously soaked with water. The set thus formed was treated for 2 minutes at 70° C. in the same way as in the first step. During this time, the dye was transferred from the photosensitive element to the image-receiving element. Both layer elements were then separated from one another. A magenta-colored negative image of the original was obtained on the image-receiving element.

The development results obtained with compounds P 1, P 2, P 3 and P 4 according to the invention and with the comparison compounds with and without addition of gelatin are shown in Table 1.

TABLE 1

| Sample | Addition (1 g) | D min | / | D max |
|---|---|---|---|---|
| 1 | P 1 | 0.19 | | 2.02 |
| 2 | P 2 | 0.15 | | 1.58 |
| 3 | P 3 | 0.18 | | 1.92 |
| 4 | P 4 | 0.16 | | 1.83 |
| 5 | none | 0.26 | | 1.23 |
| 6 | gelatin | 0.21 | | 0.89 |

The Dmin/Dmax relation is distinctly improved by addition of the compounds according to the invention. Compared with sample 5 (no addition) and, above all, sample 6 (with gelatin), minimal density is reduced and maximal density significantly increased.

EXAMPLE 2

The procedure was as in Example 1, except that, instead of compound P 1, 1 g of each of compounds P 5, P 6, P 7 and P 8 according to the invention was added to layer 1. Samples 7 to 10 were obtained in this way. Samples 7 to 10 were also added to the casting solution in the form of aqueous dispersions.

In another sample 11, polymer P-X was added for comparison instead of one of the compounds according to the invention.

Exposure and development were carried out as described in Example 1. The results are shown in Table 2.

TABLE 2

| Sample | Addition (1 g) | D min | / | D max |
|---|---|---|---|---|
| 7 | P 5 | 0.17 | | 1.92 |
| 8 | P 6 | 0.19 | | 1.58 |
| 9 | P 7 | 0.21 | | 2.16 |
| 10 | P 8 | 0.18 | | 2.04 |
| 11 | P-X | 0.19 | | 1.11 |

Table 2 shows that, compared with the comparison polymer P-X, the compounds P 5, P 6, P 7 and P 8 according to the invention above all produce a distinct increase in density.

Comparison polymer P-X $$-(CH_2-\underset{\underset{COOC_2H_5}{|}}{CH}-)_x$$

polyethylacrylate

EXAMPLE 3

The procedure was as in Example 1, except that, instead of compound P 1, 4 g of compound P 7 according to the invention was added to layer 1 (sample 12). In another two samples, 4 g of each of the comparison compounds P-X (sample 13) and P-Y (sample 14) were added.

Processing as described in Example 1 produced the following results:

TABLE 3

| Sample | Addition (4 g) | D min | / | D max |
|---|---|---|---|---|
| 12 | P 7 | 0.15 | | 1.74 |
| 13 | P-X | 0.19 | | 1.38 |
| 14 | P-Y | 0.20 | | 1.39 |

Table 3 shows that, even when applied in increased quantities, compound P 7 according to the invention produces a distinctly improved Dmin/Dmax relation compared with comparison polymers P-X and P-Y.

Comparison polymer P-Y $$-(CH_2-\underset{\underset{COOC_4H_9}{|}}{CH}-)_x$$

polybutylacrylate

EXAMPLE 4

A photosensitive element of a color-photothermographic recording material for the diffusion transfer process was prepared by successively applying the layers described below to a transparent layer support of polyethylene terephthalate having a thickness of 175 μm. All the quantities indicated are based on 1 $m^2$; for silver halide, the corresponding quantity of silver (Ag) is quoted.

1. A green-sensitive layer comprising a green-sensitized silver halide emulsion (0.67 g Ag; 95 mole % AgBr; grain diameter 0.14 μm) and 5 mole % AgI; average silver benztriazolate (0.32 g Ag), 0.32 g of dye producing compound A emulsified with 0.16 g diethyl lauramide, 0.16 g acetylated 4-methylphenidone (auxiliary developer), 1.1 g gelatin, 0.1 g compound B and 4 g polymer P 9 according to the invention.

2. A layer containing 1.0 g guanidine trichloroacetate (base donor) and 0.5 g gelatin.

3. A protective layer of 0.5 g gelatin (hardener was applied with this protective layer).

Sample 15 was obtained in this way. Further samples were similarly prepared, but with 4 g of polymer P 10 according to the invention (sample 16) and 4 g of polymer P 11 (sample 17). Another sample 18 (no addition) was used for comparison.

Processing was carried out as described in Example 1. The results are shown in Table 4.

TABLE 4

| Sample | Addition (4 g) | D min / | D max |
|---|---|---|---|
| 15 | P 9 | 0.18 | 1.27 |
| 16 | P 10 | 0.15 | 1.33 |
| 17 | P 11 | 0.16 | 1.37 |
| 18 | none | 0.21 | 0.92 |

Despite significant variation of the comonomer ratios, the polymers according to the invention still lead to an improved Dmin/Dmax relation.

We claim:

1. A color photographic recording element developable by heat treatment comprising a layer support having thereon one or more hydrophilic layers, at least one of said hydrophilic layers, containing a photosensitive silver, halide emulsion which has a dye-releasing compound associated therewith, wherein the binder in at least one of said hydrophilic layers consists of from 10 to 90% by weight of a hydrophilic binder and of from 90 to 10% by weight of a polymer containing recurring units having at least one group selected from the group consisting of urethane and urea groups which polymer is either a homopolymer or a copolymer containing recurring units of a polymerized monomer M which contains a polymerizable ethylenically unsaturated group and at least one of a urethane and a urea group and corresponds to one of formulae I, II and III

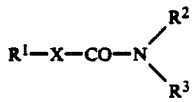

I

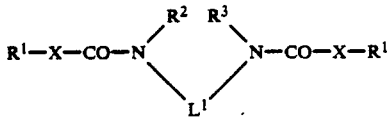

II

-continued

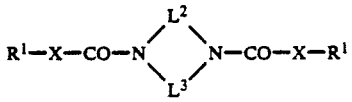

III in which

X represents —O—, —$R^4$—;

$R^1$ to $R^4$ may be the same or different and represent hydrogen, alkyl containing from 1 to 20 C-atoms, cycloalkyl, aryl, aralkyl or a heterocyclic radical, and in which $R^2$ and $R^3$ or $R^2$ and $R^4$ and/or $R^3$ and $R^4$ may together represent the radical required to form a heterocyclic group, and at least one of the substituents $R^1$, $R^2$, $R^3$ and $R^4$ containing an ethylenically unsaturated copolymerizable group;

$L^1$ represents alkylene, arylene or aralkylene containing at most 18 C-atoms and $L^2$ and $L^3$ may be the same or different and represent alkylene containing at most 10 C-atoms, at least one of the radicals $R^1$ to $R^4$ is a radical corresponding to the following formula

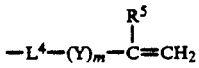

IV in which $L^4$ is an optionally substituted alkylene, arylene or aralkylene group containing at most 18 C-atoms;

Y is a difunctional bond containing at least one heteroatom;

m=0 or 1 and $R^5$ represents hydrogen, $C_1$–$C_4$ alkyl or halogen, said homopolymer consisting solely of recurring units of said polymerized monomer M and said copolymer containing, in addition to at least 10% by weight of the recurring units of said polymerized monomer M, up to 90% by weight of the recurring units of at least one other polymerized monomer C which is ethylenically unsaturated and thereby copolymerizable with said monomer M, said monomer C not containing a urethane group or a urea group and not being capable of dye formation under photographic processing conditions.

2. A recording material as claimed in claim 1, characterized in that the hydrophilic layer binder consists of gelatin.

3. A recording material as claimed in claim 1, characterized in that it contains at least one reducing agent which is capable of reducing exposed silver halide under alkaline processing conditions.

4. A recording material as claimed in claim 3, characterized in that it contains an organic, substantially nonphotosensitive silver salt which is capable of oxidizing the reducing agent in the presence of exposed silver halide under alkaline processing conditions.

* * * * *